US005653287A

United States Patent [19]

Wilson et al.

[11] Patent Number: 5,653,287

[45] Date of Patent: *Aug. 5, 1997

[54] CRYOGENIC WELL STIMULATION METHOD

[75] Inventors: Dennis R. Wilson; Robert M. Siebert; Pat Lively, all of Ponca City, Okla.

[73] Assignee: Conoco Inc., Ponca City, Okla.

[ * ] Notice: The term of this patent shall not extend beyond the expiration date of Pat. No. 5,464,061.

[21] Appl. No.: 488,919

[22] Filed: Jun. 9, 1995

Related U.S. Application Data

[63] Continuation-in-part of Ser. No. 356,593, Dec. 14, 1994, Pat. No. 5,464,061.

[51] Int. Cl.[6] ..... E21B 43/26

[52] U.S. Cl. ..... 166/302; 166/308

[58] Field of Search ..... 166/57, 299, 271, 166/302, 305.1, 306, 307, 308

[56] References Cited

U.S. PATENT DOCUMENTS

| | | | |
|---|---|---|---|
| 3,822,747 | 7/1974 | Maguire, Jr. | 166/259 |
| 4,391,327 | 7/1983 | DeCarlo | 166/307 |
| 4,400,034 | 8/1983 | Chew | 166/307 X |
| 4,534,413 | 8/1985 | Jaworowsky | 166/302 |
| 4,544,037 | 10/1985 | Terry | 299/12 X |
| 5,085,274 | 2/1992 | Purl et al. | 166/252 |
| 5,147,111 | 9/1992 | Montgomery | 299/16 |
| 5,511,905 | 4/1996 | Bishop et al. | 166/57 X |

*Primary Examiner*—David J. Bagnell
*Attorney, Agent, or Firm*—John E. Holder

[57] ABSTRACT

Hydrocarbon fluid recovery from wells extending into subterranean formations is stimulated by treatment of the near-wellbore formations with cryogenic liquid.

14 Claims, No Drawings

CRYOGENIC WELL STIMULATION METHOD

RELATED APPLICATION

This application is a continuation in part of application Ser. No. 08/356,593 of Dennis R. Wilson et al filed Dec. 14, 1994; now U.S. Pat. No. 5,464,061.

BACKGROUND OF THE INVENTION

1. Field of the Invention

This invention relates to recovery of hydrocarbon fluids from subterranean earth formations. More particularly, the invention relates to a process wherein cryogenic liquid such as liquid nitrogen is utilized to increase the permeability of a hydrocarbon fluid-containing formation penetrated by a wellbore.

2. Background Art

Presently, hydrocarbon fluids are produced through wells drilled into subterranean earth formations. Once a well is drilled and completed, it is common to treat the formation in order to stimulate the production of hydrocarbon fluids therefrom. One commonly used stimulation treatment involves hydraulically fracturing the formation. However, conventional hydraulic fracturing processes involve producing the fracturing fluid back through the wellbore, and this sometimes leaves permeability-reducing debris in the formation, and proppant sand often plugs horizontal wells. Gaseous fracturing fluids produce problems because of inability to adequately carry proppants and flow diverters, and foam fracturing fluids often leave flow-reducing residues. Also, sand or similar proppants sometimes produce back, plugging the well and/or damaging surface production equipment.

A technique which has been proposed for stimulating methane production from a coal seam is one which is sometimes referred to as "cavity induced stimulation". In one form of that process, a wellbore is charged with a gas followed by a water slug. The well pressure is then reduced and the injected gas and water produce back and create a cavity by breaking up coal around the borehole face.

Cycling of the gas-water injection and blowdown followed by debris cleanout produces an enlarged wellbore cavity. However, this technique is not effective on many coal seams.

A variation of the cavity induced stimulation process in which liquid carbon dioxide is injected into the coal seam is described in U.S. Pat. No. 5,147,111 to Montgomery.

A method of stimulating water flow from a dry well is described in U.S. Pat. No. 4,534,413 to Jaworowsky. That method involves alternate pressurization and depressurization of a well with liquid or gaseous nitrogen or carbon dioxide to fracture the borehole surface.

U.S. Pat. No. 4,391,327 to DeCarlo describes injection of a foamed fluid into a coal seam to improve gas permeability.

U.S. Pat. No. 4,400,034 to Chew describes use of a drying gas to improve coal permeability.

U.S. Pat. No. 4,544,037 to Terry describes a gas injection procedure for treating wet coal prior to producing gas from the coal.

U.S. Pat. No. 5,085,274 to Puri et al describes a method of recovering methane from a coal bed by injection of a desorbing gas.

While the above-described processes have improved production in many cases, there remains a need for an improved stimulation process which is cheaper, safer and more effective than currently available processes.

SUMMARY OF THE INVENTION

According to the present invention, a production stimulation process is provided that effectively improves hydrocarbon production rates even from formations that are not responsive to conventional stimulation procedures.

An essential feature of this invention is the use of liquid nitrogen to treat the near wellbore area of a hydrocarbon fluid-containing formation. The extreme cold of liquid nitrogen, combined with the low thermal conductivity and shrinkage of the formation at lowered temperature, creates a severe thermal stress area where a warm section of formation meets a cold section of formation. The resulting stress causes the formation to become weak and friable. Also, the water within the formation is quickly frozen at the point of contact with liquid nitrogen, and the resulting swelling during ice formation contributes to crumbling and disintegration of the formation. Further, liquid nitrogen has a very low viscosity, and will penetrate into cleats, fractures and voids, where expansion of nitrogen as it warms further contributes to weakening and fracturing of the formation.

A further essential feature of the invention involves providing a heat transfer barrier between the liquid nitrogen which is pumped down a well tubing and the portion of the well outside the tubing. Wells to be treated generally are lined with a steel casing, and without a heat transfer barrier the temperature lowering caused by the injected liquid nitrogen flowing through the well tubing could cause the well casing to fail. Also, a high rate of heat transfer through the tubing could cause an excessive amount of liquid nitrogen vaporization in the tubing. A twofold approach to creating a heat transfer barrier involves (1) using a tubing having a low thermal conductivity, and (2) flowing a warm gas down the well annulus during liquid nitrogen injection to insulate the well casing from the cold tubing. The tubing having low thermal conductivity is preferably a composite tubing comprised of fibers of glass, aramid, carbon or the like in a polymeric matrix. A particularly preferred tubing, low in cost and with high cold strength and very low thermal conductivity, is comprised of fiber glass in an epoxy matrix.

In one aspect, a modified "cavity induced stimulation" is used in which a gas (air or gaseous nitrogen) is injected into the near wellbore portion of the formation. A slug of water follows the gas injection, and after the water is displaced into the wellbore face it is followed with a slug of liquid nitrogen. The nitrogen freezes the formation surface as well as the water near the face. The well is then depressured, and the pressure in the formation acts to blow the wellbore skin into the wellbore and create a cavity. The procedure can be repeated as desired with cleanout of debris as appropriate.

In a modification of the above process, either in addition to or in lieu of the steps described, the formation is injected with liquid nitrogen at formation fracturing pressure. In a further variation, the liquid nitrogen can include water ice particles which act as a temporary proppant for the fracturing process. The formation is a heat source for the liquid nitrogen, and as the nitrogen flows into newly created fractures it will be vaporized. The expansion will contribute to the fracturing energy. A particular advantage of this process is that the fracturing fluid is produced back as a gas, avoiding the potential for formation damage which some fracturing fluids cause.

In still another aspect of the invention, a difficult to handle treatment chemical can be incorporated in the liquid nitrogen and transported to the formation. For example, acetylene gas is unstable at pressures over 80 psig, but it can be frozen into solid pellets and pumped in with liquid nitrogen. When the acetylene warms, it will be in an area where the pressure is several hundred psi, and it will explode violently of its own accord, providing a type of explosive fracturing not heretofore available.

In its broadest aspect, the invention is not limited to hydrocarbon production. For example, production of a non-hydrocarbon fluid from a well can be enhanced by the process of the invention. Additionally, the capacity of an injection well or disposal well can be increased by the process of the invention.

DESCRIPTION OF THE PREFERRED EMBODIMENTS

An essential feature of this invention involves transporting liquid nitrogen from a source to a subterranean formation. Ordinary steel is not suitable for this service, so other materials must be utilized. Stainless steel piping can be used to transfer liquid nitrogen to a wellhead manifold (also of stainless steel), and a tubing string of composite material such as fiber glass tubing or its equivalent connected to the manifold and extending down the well is a preferred mode. Fiber glass tubing is preferred over stainless steel tubing because it is a lower cost, lighter weight and lower thermal conductivity material than stainless steel. The manifold preferably includes provisions for flowing material from several sources into the tubing string.

All embodiments of this invention involve injection of liquid nitrogen down the wellbore. There has been concern that the extremely low temperatures involved, even when low heat conductivity fiberglass tubing is used to provide a thermal barrier, could damage the ordinary steel casings typically used to complete wells. The casings normally extend to the top of the hydrocarbon fluid-bearing formation. This problem is overcome by enhancing the thermal barrier by injecting a flow of warm air or nitrogen gas downward through the annulus formed by the well casing and the fiber glass tubing when liquid nitrogen is being injected down the tubing. An air-water mist combination can be used for this purpose to reduce chances of an explosive mixture resulting from air injection.

BOREHOLE ENLARGEMENT EMBODIMENT

In this embodiment, a gas such as moist air or nitrogen is first injected into the near wellbore area of a hydrocarbon fluid-bearing formation. The gas is followed by a water slug, which is then displaced into the near wellbore area, such as by injection of gaseous nitrogen down the injection tubing. After the injection tubing and borehole are substantially free of water, liquid nitrogen is injected down the tubing to contact the borehole face and create thermal stresses at the borehole face. The liquid nitrogen thermally weakens the contacted formation and also freezes the water in the formation immediately surrounding the wellbore, creating a temporary face skin at least partially sealing the borehole surface to flow in either direction. Preferably, at least while liquid nitrogen is being pumped down the tubing, warm gas is simultaneously injected down the annulus to insulate the well casing from the low temperature created by liquid nitrogen flowing down the tubing.

After injection of liquid nitrogen is complete, the well is depressured, and the combination of natural formation pressure and the gas injected into the formation acts to blow out the wellbore surface face, which as mentioned previously has been weakened by thermal stresses and the expansion forces of water freezing in the formation.

The process may be repeated several times, depending on the extent of cavity enlargement desired. The resulting debris may be removed one or more times prior to placing the well into production.

FORMATION FRACTURING EMBODIMENT

In this embodiment, which may be in addition to the above-described cavity enlargement process, or which may be a stand-alone process, liquid nitrogen is injected down the wellbore through a fiberglass tubing or its equivalent, while moist air or preferably gaseous nitrogen is injected down the well through the annulus formed by the well casing and tubing. The liquid nitrogen is pumped at fracturing pressure, and the thermal effects enhance the fracturing. As liquid nitrogen is forced into a new fracture, newly exposed formation is contacted, vaporizing some nitrogen to increase or support the fracturing pressure.

The fiberglass tubing has low heat conductivity and capacity, so only a small amount of the liquid nitrogen is vaporized in the tubing during the pump down.

In a particularly preferred embodiment, water ice crystals are utilized as a temporary proppant and flow diverter in the fracturing process. The crystals may be formed by spraying water into the liquid nitrogen either in the well or at the surface. A major advantage in the process is that the nitrogen will vaporize and the ice will melt and/or vaporize so that both will flow back without leaving a permeability-damaging residue as conventional fracturing fluids do.

In a further variation of the fracturing process, a water slug may precede the nitrogen injection. The water tends to fill existing fractures and as it would quickly freeze on contact with liquid nitrogen it would prevent premature leak off and also act as a flow diverter. When a water slug precedes the nitrogen, the water has to be cleared from the injection tubing and from the borehole prior to liquid nitrogen injection to prevent ice formation and plugging. This is preferably done by following the water slug with a gas purging step.

THE CHEMICAL TREATMENT EMBODIMENT

In this embodiment, a treatment chemical which is difficult to handle at ambient conditions, because of volatility or reactivity, for example, can be incorporated in a liquid nitrogen stream which allows for safe handling and injection of the chemical.

When the injected chemical is warmed by the formation to be treated, the desired reaction can take place safely. For example, acetylene gas is unstable at pressures above 15 psi, but it can be frozen into solid pellets with liquid nitrogen and pumped into a well. When it is warmed by the formation, it will be at a pressure of several hundred psi and will explode violently without the need for a co-reactant or detonator. The resulting explosive fracturing may be part of a combination treatment or an independent process. As in the other embodiments, injection of a warm gas through the well annulus during liquid nitrogen injection through the tubing prevents thermal damage to the well casing.

All of the above-described processes also have utility in treating disposal wells and wells where fluids other than hydrocarbons are to be produced.

EXAMPLE

In this Example, a tight methane-bearing earth formation is penetrated by a cased wellbore. Liquid nitrogen is injected into the formation adjacent the wellbore by pumping the liquid nitrogen down a fiber glass tubing extending from the surface to the formation. Simultaneously, a warm gas is injected down the annulus between the tubing and the well casing to thermally insulate the casing from the effects of the liquid nitrogen. After treatment of the near wellbore portion of the formation with liquid nitrogen, resulting in increased near-wellbore permeability, methane is produced from the well.

DESCRIPTION OF EQUIPMENT

The extremely low temperature of liquid nitrogen presents special problems in carrying out the invention. Ordinary carbon steel is not suitable for cryogenic service, so the injection tubing must be specially designed. A preferred tubing material is a composite of fiber glass in a polymeric matrix, which maintains its strength at liquid nitrogen temperatures, and has a low heat conductivity. Tubing centralizers are preferably used to maintain uniform spacing between the tubing and the well casing. The tubing is adapted to connect to an above ground manifold, which can be of stainless steel, and stainless steel or other appropriate cryogenic piping can extend from the manifold to the liquid nitrogen source. The liquid nitrogen source is preferably one or more transportable tanks, each of which is connected to the manifold. A gaseous nitrogen source also may be connected to the manifold by appropriate means. The gaseous nitrogen source preferably is a liquid nitrogen tank with a heat exchanger at the tank's discharge for warming and gasifying the nitrogen. A water source may also be connected to the manifold if water is to be injected. The manifold needs to be capable of directing gaseous nitrogen or air down the well annulus to provide low temperature protection for the casing, and down the tubing to purge water from the tubing to prevent plugging of the tubing with ice.

A spray injector to provide ice crystals in the liquid nitrogen or to add a treatment chemical to the liquid nitrogen may be located in the well or above ground as appropriate.

The foregoing description of the preferred embodiments is intended to be illustrative rather than limiting of the invention, which is to be defined by the appended claims.

We claim:

1. A method for improving hydrocarbon fluid production from a cased wellbore extending into a subterranean formation comprising:

(a) providing a tubing in said wellbore for conveying liquid nitrogen from the surface to said formation, said tubing having low thermal conductivity and comprised of composite fibers in a polymeric matrix;

(b) providing a heat transfer barrier between the wellbore casing and the interior of said tubing;

(c) injecting liquid nitrogen through said tubing to said formation whereby the face of said wellbore adjacent said formation is contacted with liquid nitrogen, and during injection of said liquid nitrogen, flowing a gas down the annulus between said casing and said tubing; and (d) producing hydrocarbon fluid from said formation through said wellbore.

2. The method of claim 1 wherein a gas is injected into said formation adjacent said wellbore prior to said injection of liquid nitrogen.

3. The method of claim 2 wherein water is injected into said formation adjacent said wellbore after said injection of gas and prior to said injection of liquid nitrogen.

4. The method of claim 1 wherein said formation adjacent said wellbore is contacted with liquid nitrogen a plurality of times followed by production of hydrocarbon fluid therefrom.

5. The method of claim 1 wherein said liquid nitrogen contains an added treatment chemical which is reactive in said formation after injection thereinto.

6. The method of claim 1 wherein said liquid nitrogen is injected into said formation at a pressure exceeding the fracture pressure of said formation.

7. The method of claim 6 wherein said liquid nitrogen includes water ice particles.

8. The method of claim 1 wherein said tubing is formed composite fibers selected from the group consisting of glass, aramid, or carbon.

9. The method of claim 1 wherein said tubing is formed of fiber glass in an epoxy matrix.

10. A method of improving hydrocarbon fluid production from a wellbore extending into a subterranean formation comprising:

(a) providing a wellbore from the surface through at least a portion of said formation;

(b) casing said wellbore from the surface to adjacent the top of said formation;

(c) providing a tubing string through said wellbore from the surface to a point adjacent said formation;

(d) charging said formation by injecting a gas down said wellbore and into said formation;

(e) injecting a slug of water into said formation behind said injected gas;

(f) injecting a gas behind said water slug to clear water from said tubing and wellbore;

(g) injecting liquid nitrogen into said formation at fracturing pressure;

(h) displacing liquid nitrogen into said formation from said tubing and borehole;

(i) closing said well to enable said liquid nitrogen to warm up and vaporize; and (j) opening said well to enable vaporized nitrogen to flow out followed by production of hydrocarbon fluid from said well.

11. A method for increasing the permeability of a subterranean formation in the area of a wellbore penetrating said formation comprising:

(a) providing a casing in said wellbore;

(b) providing a tubing in said wellbore for conveying liquid nitrogen from the surface to said formation, said tubing having low thermal conductivity and comprised of composite fibers in a polymeric matrix;

(c) providing a heat transfer barrier between said casing and the interior of said tubing; and (d) injecting liquid nitrogen through said tubing to said formation whereby the face of said wellbore is contacted with liquid nitrogen and the permeability of said formation adjacent said wellbore is increased.

12. The method of claim 11 wherein a gas is flowed down the annulus between said casing and said tubing during injection of said liquid nitrogen.

13. A method for improving hydrocarbon fluid production from a cased wellbore extending into a subterranean formation comprising:

(a) providing a tubing in said wellbore for conveying liquid nitrogen from the surface to said formation;

(b) providing a heat transfer barrier between the wellbore casing and the interior of said tubing;

(c) injecting liquid nitrogen through said tubing to said formation whereby the face of said wellbore adjacent said formation is contacted with liquid nitrogen, said liquid nitrogen containing an added treatment chemical which is reactive in said formation after injection thereinto, and (d) producing hydrocarbon fluid from said formation through said wellbore.

14. A method for improving hydrocarbon fluid production from a cased wellbore extending into a subterranean formation comprising:

(a) providing a tubing in said wellbore for conveying liquid nitrogen from the surface to said formation;

(b) providing a heat transfer barrier between the wellbore casing and the interior of said tubing;

(c) injecting liquid nitrogen through said tubing into said formation at a pressure exceeding the fracture pressure of said formation to fracture the formation;

(d) forming ice crystals in the liquid nitrogen which is injected into said formation to serve as a temporary propant and flow diverter when the formation is fractured; and (e) producing hydrocarbon fluid from said formation through said wellbore.

* * * * *